US005897821A

United States Patent [19]

Kawasaki

[11] Patent Number: 5,897,821

[45] Date of Patent: Apr. 27, 1999

[54] METHOD FOR MANUFACTURING CHITOSAN FIBER

[75] Inventor: Shiro Kawasaki, Okayama, Japan

[73] Assignee: Japan Exlan Company Limited, Osaka, Japan

[21] Appl. No.: 08/918,372

[22] Filed: Aug. 26, 1997

[30] Foreign Application Priority Data

Sep. 5, 1996 [JP] Japan ..... 8-257476

[51] Int. Cl.[6] ..... D01F 4/00

[52] U.S. Cl. ..... 264/186

[58] Field of Search ..... 264/186, 202

[56] References Cited

U.S. PATENT DOCUMENTS 4,029,727 6/1977 Austin et al. ..... 264/186
4,062,921 12/1977 Austin ..... 264/186 X

FOREIGN PATENT DOCUMENTS 59-116418 7/1984 Japan .

OTHER PUBLICATIONS

Abstract of Japan 56–26,049 (Published Mar. 13, 1981).
Abstract of Japan 60–59,123 (Published Apr. 5, 1985).
Abstract of Japan 63–175,117 (Published Jul. 9, 1988).
Abstract of Japan 1–250,413 (Published Oct. 5, 1989).

*Primary Examiner*—Leo B. Tentoni
*Attorney, Agent, or Firm*—Kennedy Covington Lobdell & Hickman, LLP

[57] ABSTRACT

The present invention offers a safe and economic method for manufacturing chitosan fiber wherein an aqueous solution of sodium thiocyanate is used. In the present invention, chitosan having a degree of deacetylation of not less than 60% is dissolved in an aqueous solution of not less than 44% by weight of sodium thiocyanate and the resulting spinning solution is subjected to a wet spinning to manufacture a chitosan fiber.

4 Claims, No Drawings

METHOD FOR MANUFACTURING CHITOSAN FIBER

BACKGROUND OF THE INVENTION

The present invention relates to a method for manufacturing chitosan fiber by means of wet spinning using an aqueous solution of sodium thiocyanate as a solvent.

Because of the necessity of providing a healthy and hygienic environment, many fiber products processed with an antibacterial treatment have been produced. The art of providing antibacterial properties using antibacterial metal carried on zeolite is disclosed in Japanese patent publication Sho-63/054,013 and in Japanese laid-open patent publications Sho-63/175,117 and Hei-01/250,413. Also, a method of applying antibacterial agents of an antibacterial quaternary ammonium salt type to fiber or to cloth has been known in the art.

However, fiber and cloth prepared by such methods often cause inflammation, etc., to human skin depending upon the use, resulting in discomfort and problems in terms of safety and hygiene.

In view of the above, attempts have been made to utilize chitin or chitin derivatives having relatively low toxicity and high safety to human body.

Chitosan, which is one of the derivatives of chitin, is prepared by heating chitin in the presence of an alkali followed by hydrolyzing for deacetylation. Said chitin, which is a polysaccharide having an N-acetyl-D-glucosamine-beta-1-,4-glucoside bond, is contained in crustaceans, such as shrimp and crabs, and insects, such as beetles and grasshoppers, and is available in large quantities in nature. Chitosan has the properties of allowing permeation of water and low-molecular compounds therethrough, exhibiting a good anticoagulant action, and shows a good affinity with tissues of living organisms, rarely causing an undesirable tissue reaction. In view of such characteristics, application of chizosan as a biomaterial has been conducted and its utilization in microcapsule materials, dialysis membrane, artificial organs, surgical materials, etc. has been attempted.

At present, in order to subject chitosan to wet spinning, there is a disclosure in Japanese laid-open publication Sho-56/026,049 of a method in which chitosan is dissolved in an aqueous solution of acetic acid and the resulting solution (a spinning solution) is spun into a mixed solvent of alcohol and water to make into fiber. However, this method has a disadvantage that, when chitosan is dissolved in an aqueous solution of acetic acid, the viscosity of the resulting spinning solution is extremely high, since the intermolecular hydrogen bond of chitosan is strong, whereby the ability of the solution to be spun decreases. In order to improve this disadvantage, there is a proposal in Japanese laid-open patent publication Sho-59/116,418 where a spinning solution is prepared by dissolving chitosan in a mixed solvent of water and dichloroacetic acid or by dissolving acid addition salt of chitosan in water or in a mixed solvent of water and dichloroacetic acid, and the resulting spinning solution is molded/coagulated in an aqueous solution of metal salt followed by treating with a chelate reagent, whereby improvement in the ability of the solution to be spun and acceleration of coagulation of the spinning solution are attempted.

However, some of the chemicals used in the above processes are strongly irritative and cause a danger upon actual use and, therefore, in Japanese laid-open patent publication Sho-60/059,123, chitosan or an acid addition salt thereof is dissolved in a mixture of an aqueous solution of acetic acid and urea whereupon the problem of use of irritative, dangerous chemicals is solved.

Another study in which a specialized solvent such as hexafluoroisopropyl alcohol or hexafluoroacetone is used has also been reported.

In the above-mentioned methods for manufacturing chitosan fiber which have been proposed up to now, chemicals which are toxic to human body, such as being strongly irritative to skin, have been used. Even in the invention of the Japanese laid-open patent publication Sho-60/059,123 wherein such a problem is improved, the strong odor associated with the chemicals in that process is a disadvantage, and upon production on an industrial scale, the method is not practical because of this strong, offensive odor. In addition, the organic acids used are highly corrosive to metal and, therefore, in a process for manufacturing chitosan fiber using acetic acid and dichloroacetic acid as solvents, measures against corrosion are to be taken into consideration. In the case of use of specialized solvents, such solvents are very expensive and, therefore, use of such solvents is also not practical.

SUMMARY OF THE INVENTION

Therefore, it is an object of the present invention to offer a method for manufacturing chitosan fiber using a solvent which is commonly used in industry having none of the above-mentioned problems.

This object can be achieved by adopting a method in which chitosan having a degree of deacetylation of not less than 60% is dissolved in an aqueous solution of sodium thiocyanate having a concentration of not less than 44% by weight and the resulting spinning solution is molded by means of a wet spinning. Better spinning can be achieved when the coagulation liquid is water, a water-soluble organic solvent, or a mixture thereof, as well as any of them to which sodium thiocyanate is added.

DESCRIPTION OF THE PREFERRED EMBODIMENT

The present invention provides a method for manufacturing chitosan fiber in which chitosan is dissolved in an aqueous solution of sodium thiocyanate, then spun using a conventional spinning process, such as wet spinning or dry-wet spinning.

The concentration of the aqueous solution of sodium thiocyanate is to be not less than 44% by weight. When the concentration is less than 44% by weight, chitosan is not dissolved therein but only a partial swelling takes place. With regard to the upper limit of the concentration, there is no particular limit but, since the solubility of sodium thiocyanate at 100° C. is 70% by weight, the solution must be kept at 100° C. when the concentration is 70% by weight or more, and that is not practical. Accordingly, if the upper limit is to be regulated, the concentration of 60% to 65% by weight would be practical.

Chitosan which can be used in the present invention forms a homogeneous solution when dissolved in an aqueous solution of sodium thiocyanate. Chitosan which satisfies this requirement has a degree of deacetylation of not less than 60% or, preferably, not less than 70%. When chitosan having a degree of deacetylation of less than 60% is dissolved in an aqueous solution of sodium thiocyanate, some of chitosan may be left undissolved. The degree of deacetylation is defined as the ratio of amide group in the starting chitosan converted into amino group as a result of deacetylation and can be determined by an quantitative analysis of the amino group in chitosan by means of titration.

Like in the process for manufacturing acryl fiber, a wet-spinning and dry-wet spinning can be advantageously adopted as a method of spinning. Thus, the spinning solution is coagulated by extruding into a coagulation liquid either directly or via an inert atmosphere and then the coagulated fiber is washed with water and elongated, followed, if necessary, by subjecting the fiber to a heating or finishing treatment.

Coagulation liquid which can be advantageously applied includes water; alcohols, such as methanol, ethanol, and isopropyl alcohol; water-soluble organic solvents, such as acetone and acetonitrile, or a mixture of such a water-soluble organic solvent with water; and a mixture of those liquids with sodium thiocyanate for controlling the coagulating rate. In an industrial scale production, the use of water only is preferred but, when the chitosan concentration in the spinning solution is low, there is a disadvantage in the sole use of water because considerable time may be required for coagulation in the coagulation liquid, whereby the length of the coagulation bath must be undesirably excessive. In view of the above, in some cases, the use of a mixed solution of water, water-soluble organic solvent, and sodium thiocyanate is preferred.

Although a mechanism for the antibacterial, antifungal, and deodorizing actions of chitosan is ambiguous, it has been presumed that, when chitosan is made into a quaternary compound, its cationic amino group absorbs the anion-constituting substances in cells of the microorganisms and, as a result, biosynthesis of cell walls is inhibited whereupon an antibacterial action is achieved.

Details of the dissolution mechanism of chitosan in an aqueous solution of sodium thiocyanate is also ambiguous. However, it has been known that the thiocyanate ion generally inhibits a hydrogen bond and, therefore, it is presumed that this ion inhibits the intermolecular and intramolecular hydrogen bonds of chitosan whereby a dissolution is achieved.

EXAMPLES

The following examples are provided for making the understanding of the present invention easier, although they are only for exemplification and are not intended to limit the characteristic features of the present invention thereto.

The terms "parts" and "percentages" used in the examples are those by weight unless otherwise stipulated.

Example 1

Chitosan having degrees of polymerization of 350 to 410 where the degree of deacetylation varied as shown in Table 1 was dispersed in an aqueous solution of sodium thiocyanate of a predetermined concentration and the resulting dispersion was heated at 100° C. for two hours with stirring to dissolve. The resulting spinning solution was subjected to a wet spinning using acetone as a coagulation liquid kept at 4° C., washed with water, and dried at 80° C. to prepare a chitosan fiber. States of dissolution and spinning of chitosan and the physical properties of the resulting chitosan fiber were evaluated and the results are given in Table 1. It is understood that the spinning solutions for the fibers No. 1 through No. 3 satisfying the requirements of the present invention are homogeneous without insoluble matters and both spinning state and fiber characteristics are satisfactory.

TABLE 1

| | Degree of Deacetylation | Concentration of Sodium Thiocyanate | Dissolving State | Spinning State | Denier (d) | Strength (g/d) |
|---|---|---|---|---|---|---|
| No. 1 | 84% | 60% | ○ | ○ | 15 | 0.50 |
| No. 2 | 65% | 60% | ○ | ○ | 14 | 0.52 |
| No. 3 | 84% | 45% | ○ | ○ | 15 | 0.46 |
| No. 4 | 59% | 60% | x | — | | |
| No. 5 | 84% | 42% | x | — | | |

○:good,
x:poor

Comparative Example 1

Chitosan having a degree of deacetylation of 59% was dispersed in a 60% aqueous solution of sodium thiocyanate and heated at 100° C. for two hours with stirring for dissolution. The resulting solution contained insoluble matters and was not able to be used as a spinning solution (No. 4, Table 1).

Comparative Example 2

Chitosan having a degree of deacetylation of 84% was dispersed in a 42% aqueous solution of sodium thiocyanate and heated at 100° C. for two hours with stirring for dissolution. Although chitosan was swollen to some extent, it was not dissolved (No. 5, Table 1).

When chitosan or sodium thiocyanate concentrations are out of the scope of the present invention, it is not possible to manufacture even a spinning solution which can be subject to a spinning procedure.

As mentioned hereinabove, a feature of the present invention is that a solvent which is safe and nontoxic is used, resulting in an industrially advantageous manufacturing method. A solvent containing sodium thiocyanate has already been used for manufacturing fibers of acrylic polymers and it is another economic merit of the present invention that most of the steps for manufacturing these fibers can be utilized. In addition, the fiber manufactured by the present invention can be advantageously used as material for covering a wound, material for filling tissues, etc., upon making into nonwoven fabric or the like.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for manufacturing chitosan fiber comprising the steps of dissolving chitosan having a degree of deacetylation of not less than 60% in an aqueous solution of sodium thiocyanate having a concentration of not less than 44% by weight, and molding the resulting spinning solution by wet spinning to form a chitosan fiber.

2. A method according to claim 1, wherein the wet spinning includes coagulating the fiber in a coagulation liquid selected from the group consisting of water, a water-soluble organic solvent, a mixture thereof, and a mixture of any of the foregoing with sodium thiocyanate.

3. A method according to claim 1, wherein the degree of deacetylation of the chitosan is not less than about 70%.

4. A method according to claim 1, wherein the concentration of sodium thiocyanate in the aqueous solution is not more than about 70% by weight.

* * * * *